US012487062B2

(12) United States Patent
Balos et al.

(10) Patent No.: US 12,487,062 B2
(45) Date of Patent: Dec. 2, 2025

(54) BATTLE TANK WITH ARMORED OVERHEAD TURRET DESIGN

(71) Applicant: University of New Hampshire, Durham, NH (US)

(72) Inventors: Sebastian Balos, Novi Sad (RS); Marko Knezevic, Durham, NH (US); Danka Labus Zlatanovic, Novi Sad (RS)

(73) Assignee: University of New Hampshire, Durham, NH (US)

( * ) Notice: Subject to any disclaimer, the term of this patent is extended or adjusted under 35 U.S.C. 154(b) by 51 days.

(21) Appl. No.: 18/474,509

(22) Filed: Sep. 26, 2023

(65) Prior Publication Data

US 2024/0118057 A1 Apr. 11, 2024

Related U.S. Application Data

(60) Provisional application No. 63/413,815, filed on Oct. 6, 2022.

(51) Int. Cl.
*F41H 5/20* (2006.01)

(52) U.S. Cl.
CPC ..... *F41H 5/20* (2013.01)

(58) Field of Classification Search
CPC ..... F41H 5/20
USPC ..... 89/36.13
See application file for complete search history.

(56) References Cited

U.S. PATENT DOCUMENTS

| | | | | |
|---|---|---|---|---|
| 4,417,499 | A * | 11/1983 | Grosser | F41A 27/18 89/36.13 |
| 2009/0114085 | A1* | 5/2009 | Diller | F41H 5/20 89/36.13 |
| 2010/0107862 | A1* | 5/2010 | Schulte | B32B 15/08 89/36.02 |
| 2021/0239416 | A1* | 8/2021 | Blache | F41A 9/42 |

FOREIGN PATENT DOCUMENTS

| | | | | |
|---|---|---|---|---|
| DE | 3121143 | A1 * | 9/1990 | F41H 5/26 |
| DE | 19604193 | C1 * | 6/1997 | F41H 7/02 |
| WO | WO-2019077310 | A1 * | 4/2019 | F41H 5/023 |

* cited by examiner

*Primary Examiner* — John Cooper
(74) *Attorney, Agent, or Firm* — Finch & Maloney PLLC

(57) ABSTRACT

Described herein is a new design for a combat vehicle, such as a battle tank, that includes enhanced armor plating overhead of the passengers inside the vehicle. The enhanced armor may include thicker plating within a turret that is arranged over where one or more passengers are seated within a turret basket. In some respects, the plated region of the turret may also protect rear features such as an auto-loader from frontal attacks. The armored turret region may have a thickness of at least 500 mm or may have a thickness that extends an entire height of the turret. One or more occupants of the combat vehicle may be seated within a turret basket beneath the turret, such that they are arranged beneath the armored turret region when seated and better protected from overhead attacks.

20 Claims, 3 Drawing Sheets

BATTLE TANK WITH ARMORED OVERHEAD TURRET DESIGN

CROSS REFERENCE TO RELATED APPLICATION

This application claims the benefit of U.S. Provisional Application No. 63/413,815 filed Oct. 6, 2022, the disclosure of which is incorporated be reference herein in its entirety.

FIELD OF THE DISCLOSURE

The present disclosure relates generally to the design of combat vehicles, such as battle tanks.

BACKGROUND

A tank or main battle tank (MBT) is one of the most powerful conventional ground armored vehicles. Different types of tanks prioritize different segments of the iron triangle: firepower, survivability/protection, and mobility. A steady increase in protection over the years was mainly aimed at increasing the frontal armor protection of the tank. Despite a significant increase in the effectiveness of armor, coming from the emergence of more effective materials and configurations, some sacrifices have been made. Consequently, frontal, and in some MBTs, side armor increased several fold over the years, however, roof armor has remained largely poor.

SUMMARY

In one aspect, a combat vehicle is provided. The combat vehicle includes a hull, a cavity within a forward position of the hull and including a seat, and a turret arrangement disposed aft of the cavity and centrally located in the hull. The turret arrangement includes a turret basket that includes at least one seat, and a turret over the turret basket. The turret has an armored section with a thickness that is around 500 mm or greater and the armored section is arranged over the at least one seat in the turret basket. The turret arrangement may be configured to rotate about an axis that passes vertically through both the turret basket and the turret. The armored section can include a plurality of armor layers. At least one of the plurality of armor layers may include ballistic steel or an airgap. The turret may further include an autoloader and one or more hatches between the armored section and the autoloader. The at least one seat may be arranged on a track such that the at least on seat is configured to slide (or more generally move) to allow passage beneath one or more of the one or more hatches. The turret basket may include two seats that are arranged adjacent to one another and configured to face towards a front of the turret arrangement. In some embodiments, the at least one seat in the turret basket does not extend above a roof line of the hull. The turret arrangement may include a barrel (as part of a gun) extending away from the armored section.

In another aspect, a turret arrangement is configured to be coupled to a hull of a combat vehicle. The turret arrangement includes a turret basket that includes at least one seat, and a turret over the turret basket. The turret has an armored section with a thickness that is around 500 mm or greater and the armored section is arranged over the at least one seat in the turret basket. Both the turret basket and the turret may be configured to rotate about an axis that passes vertically through both the turret basket and the turret. The armored section can include a plurality of armor layers. At least one of the plurality of armor layers may include ballistic steel or an airgap. The turret may further include an autoloader and one or more hatches between the armored section and the autoloader. The at least one seat may be arranged on a track such that the at least on seat is configured to slide laterally towards the rear position of the turret arrangement and beneath one or more of the one or more hatches. The turret basket may include two seats that are arranged adjacent to one another and configured to face towards a front of the turret arrangement. In some embodiments, the at least one seat in the turret basket does not extend above a bottom surface of the turret. The turret arrangement may include a barrel extending away from the armored section.

In another aspect, a turret arrangement is configured to couple to a hull of a combat vehicle. The turret arrangement includes a turret basket that includes at least one seat, and a turret over the turret basket. The turret includes a gun with a barrel, an autoloader, and an armored section between the barrel and autoloader. A thickness of the armored section extends through an entire height of the turret and the armored section is arranged over the at least one seat in the turret basket. Both the turret basket and the turret may be configured to rotate about an axis that passes vertically through both the turret basket and the turret. The armored section can include a plurality of armor layers. At least one of the plurality of armor layers may include ballistic steel or an airgap. The turret arrangement may include one or more hatches between the armored section and the autoloader. The at least one seat may be arranged on a track such that the at least on seat is configured to slide towards the rear position of the turret arrangement (e.g., slide backwards) and beneath one or more of the one or more hatches. The turret basket may include two seats that are arranged adjacent to one another and configured to face towards a front of the turret arrangement. In some embodiments, the at least one seat in the turret basket does not extend above a bottom surface of the turret.

Figure 1A:
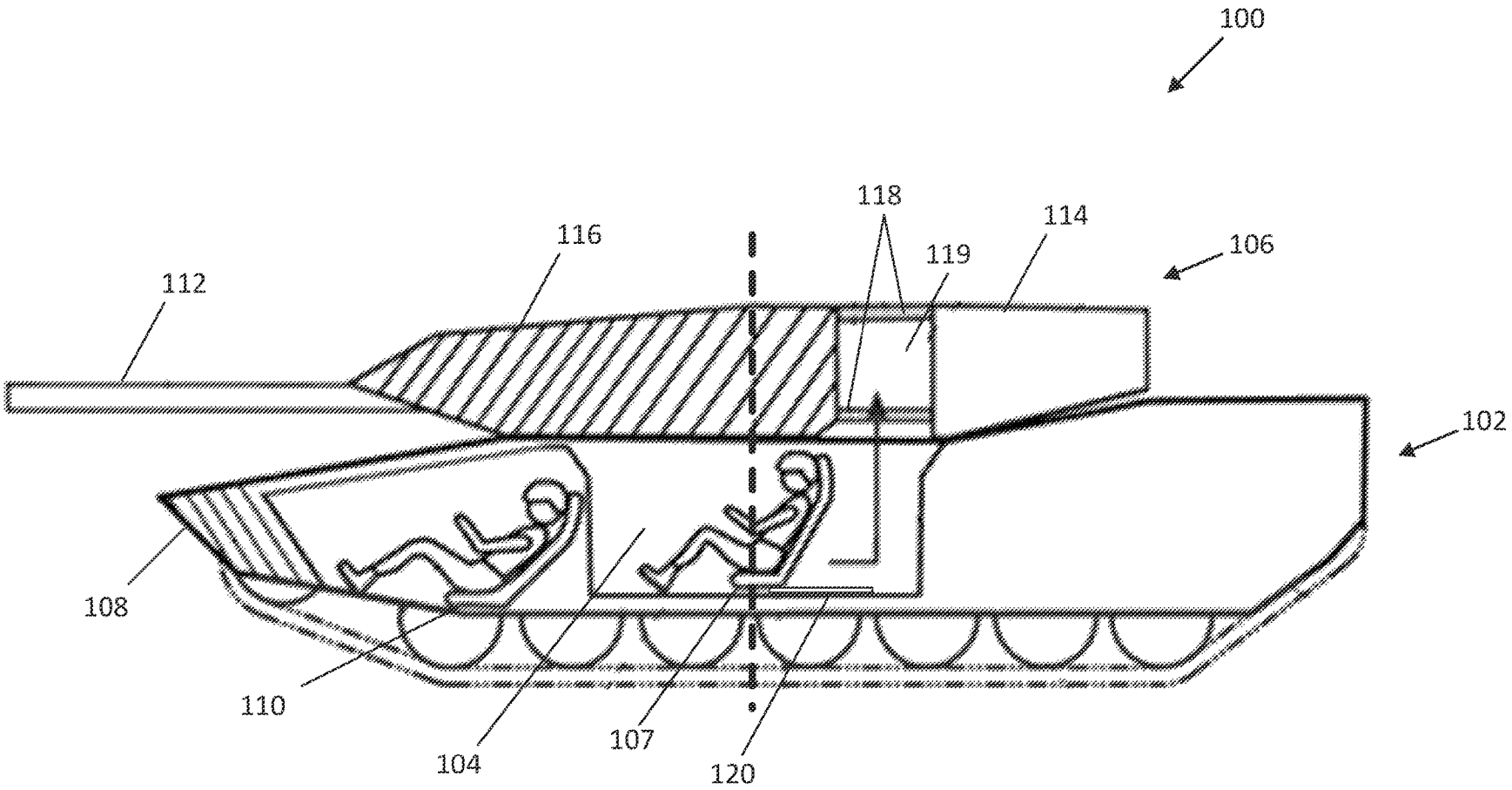
FIG. 1A illustrates a side view of a combat vehicle having a turret with an armored section over a turret basket, according to some embodiments of the present disclosure.

Various aspects of at least one example are discussed below with reference to the accompanying figures, which are not intended to be drawn to scale. The figures are included to provide illustration and further understanding of the various aspects and examples and are incorporated in and constitute a part of this specification, but are not intended to limit the scope of the disclosure. The drawings, together with the remainder of the specification, serve to explain principles and operations of the described and claimed aspects and examples. For purposes of clarity, not every component may be labeled in every figure.

GENERAL OVERVIEW

Described herein is a new design for a combat vehicle, such as a battle tank, that includes enhanced armor plating overhead of the passengers inside the vehicle. The enhanced armor may include thicker plating within a turret that is arranged over where one or more passengers are seated within a turret basket. In some respects, the plated region of the turret may also protect rear features such as an autoloader from frontal attacks or may protect portions of the gun from side attacks. The armored turret region may have a thickness of at least 500 mm or at least 700 mm or may have a thickness that extends an entire height of the turret. One or more occupants of the combat vehicle may be seated within a turret basket beneath the turret, such that they are arranged beneath the armored turret region when seated and better protected from overhead attacks.

DETAILED DESCRIPTION

Conventional turret designs for combat vehicles, such as battle tanks, use a turret that extends from a rotating turret basket. As a result, there may be little armor present along the hull beneath the turret or along a top portion of the turret basket. Consequently, occupants within the vehicle that are operating the turret are susceptible to attacks made from above them. For example, the turret crew members are seated or standing (loader), well above the hull roof line. As such, their bodies protrude well into the turret height and width space, which means the turret has a considerable size, particularly the width, well above the tracks. This also means, turret cheeks (frontal space next to the gun) have thick and massive armor, protecting the turret from the front. However, that, along with a considerable turret length also means the weight of the turret and the vehicle itself is relatively high, leaving a very light and thin armor protecting the turret top, making the whole vehicle vulnerable to top attack anti-tank weapons.

Thus, and in accordance with some embodiments, a new turret arrangement design is disclosed to provide enhanced turret armor that protects both the crew from top-down attacks as well as protects rear components of the turret (such as an autoloader and ammunition in a turret bustle) from frontal attacks. The turret armor may also protect portions of the gun from side attacks. The new turret design may include a two-man crew (commander and gunner) seated in the turret basket in a reclining position and rotating with the turret, with their heads approximately under the hull roof line. The gun may be in substantially the same position as in a conventional turret, with an autoloader in a turret bustle (conveyor, revolver or other type) or under the gun (revolver, conveyor type). One or more sights may be mounted in the turret. According to some embodiments, the turret armor may be optimized towards providing top, side and frontal protection, relying on a relatively great depth/thickness of armor. Between the optional turret bustle autoloader and the armored turret region, a space can be provided for the crew, in order to enable them to maintain top vision as in a conventional turret when standing, as well as to escape in case of emergency. Single or double hatches may be utilized to provide entrance/exit and top vision for the turret crew. The hatches may be located between the armored turret region and the backend of the turret, which may include an autoloader. Furthermore, this space can be utilized to clear stoppages and maintenance work on the autoloader and armament systems. Since the turret crew is primarily situated in the hull, under the armored turret region, the width of the disclosed turret can be made narrower compared to present turrets that extend well over the tracks, providing potential weight savings.

FIG. 1 illustrates a side view of a combat vehicle 100, such as a main battle tank (MBT). The combat vehicle may generally include two sections, a lower hull 102 and a turret arrangement that includes both a turret basket 104 and a turret 106. The turret arrangement may be configured to rotate about an axis (dashed line) that passes generally through a center of turret basket 104, such that both turret basket 104 and turret 106 rotate together. The turret basket 104 may include at least one seat 107 for one or more turret operators, such as a commander and/or a gunner. According to some embodiments, turret basket 104 is designed such that the at least one seat 107 does not extend above a top surface (e.g., a roof line) of hull 102 or above a bottom surface of turret 106.

Lower hull 102 may include a front armor section 108 protecting a driver sitting in a driver seat 110. Front armor section 108 may include reinforced steel plates or armored steel. Turret 106 may include various components that swivel together about the axis over the top surface of hull 102. For example, turret 106 may include a barrel 112 (as part of a gun) at a front end and an autoloader 114 at a back end. Autoloader 114 may include munitions for firing through barrel 112.

According to some embodiments, turret 106 also includes an armored section 116 between barrel 112 and autoloader 114. Armored section 116 may be located along turret 106 such that it is above at least one seat 107 in turret basket 104. Armored section 116 is designed to have a large thickness to provide enhanced protection from top-down attacks. According to some embodiments, armored section 116 has a total thickness that is at least 500 mm or at least 700 mm. In some embodiments, armored section 116 has a thickness that spans an entire height of turret 106.

The thicker armored section 116 provides greater flexibility for the material layers used to make up armored section 116. In some embodiments, armored section 116 includes multiple material layers that include one or more polymer layers, one or more aluminum alloy layers, one or more steel layers, one or more ceramic layers, or one or more airgap layers. Other possible material layers include ballistic steel, armored steel, or explosive reactive armor. In some embodiments, armored section 116 includes a ceramic composite material having a series of layers such as ceramic/adhesive/glass/adhesive/polymer.

According to some embodiments, one or more hatches 118 are located in armored section 116 or between armored section 116 and autoloader 114. One or more hatches may be used to provide entry/exit points into combat vehicle 100, and also to provide space for one or more occupants to stand in. For example, a lower hatch of one or more hatches 118 may be opened to allow for an occupant to stand within a space 119 between armored section 116 and autoloader 114. Once within space 119, the occupant may look out through a front-facing opening to acquire a visual inspection of the area around combat vehicle 100 or may perform maintenance on autoloader 114 or the gun. The topside hatch of one or more hatches 118 can remain closed during these operations.

According to some embodiments, the one or more seats 107 may be attached to a sliding mechanism 120 that is configured to allow the one or more seats 107 to slide backwards towards a rear section of hull 102. In some examples, the one or more seats 107 may slide backwards along sliding mechanism 120 such that they are aligned beneath one or more hatches 118. In this way, the occupant can stand straight up from their seat after sliding back and open the lower hatch of one or more hatches 118 to enter into space 119. In some embodiments, sliding mechanism 120 may be any type of mechanism that allows one or more seats 107 to move in order to allow the crew access to one or more hatches 118.

Figure 1B:
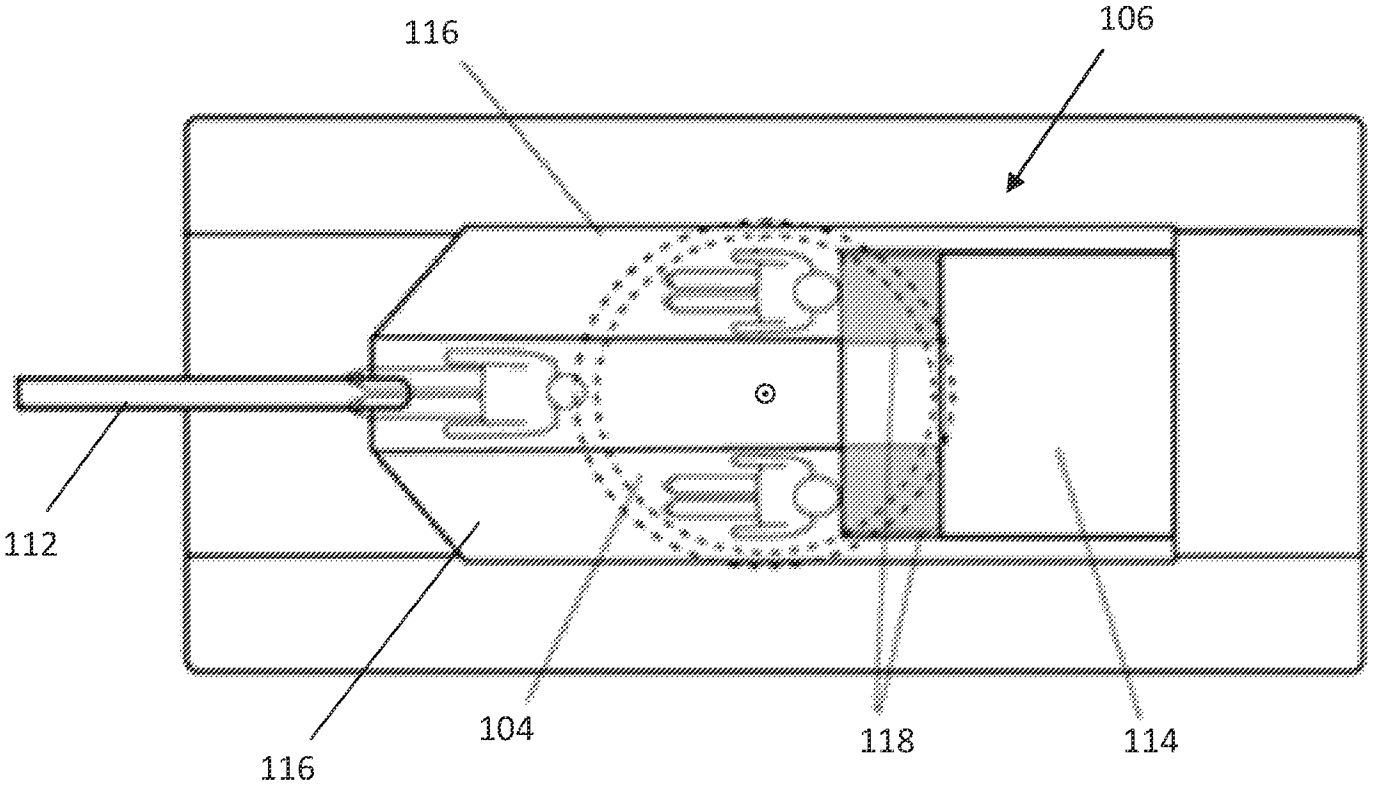
FIG. 1B illustrates a top view of the combat vehicle having the turret with an armored section over the turret basket, according to some embodiments of the present disclosure.

FIG. 1B illustrates a top-down view of combat vehicle 100, according to some embodiments. The central axis of turret basket 104 is shown about which both turret basket 104 and turret 106 rotate. In this view, it can be seen that armored section 116 of turret 106 can exist on both sides of a central portion of turret 106, such that armored section 116 protects the area above two different seats arranged adjacent to one another within turret basket 104. The central portion of turret 106 may provide a pathway for munitions to travel between autoloader 114 and barrel 112.

Also seen in the top-down view of FIG. 1B are two separate hatches (or hatch pairs) 118 aligned behind corresponding seats within turret basket 104. In this way, each occupant from each of the seats has his or her own hatch to enter/exit into/from turret basket 104.

Figure 2:
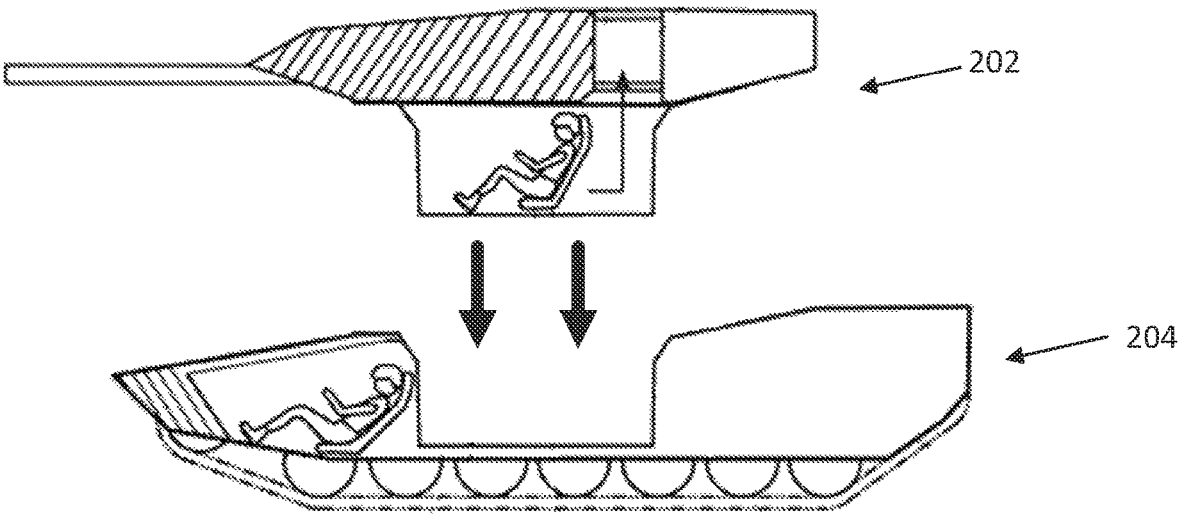
FIG. 2 illustrates a turret arrangement being coupled to a lower vehicle portion, according to some embodiments of the present disclosure.

FIG. 2 illustrates how a turret arrangement 202 can be a separate and modular structure that is coupled into a lower hull 204. In this way, turret arrangement 202 can be made to fit into various hull designs or retrofitted into older hull designs.

What is claimed is:

1. A combat vehicle, comprising:

a hull;

a cavity within a forward position of the hull and including a seat;

a turret arrangement disposed aft of the cavity and centrally located in the hull, the turret arrangement comprising a turret basket that includes at least one seat, wherein the at least one seat in the turret basket does not extend above a roof line of the hull, and a turret over the turret basket, the turret having an armored section with a thickness that is around 500 mm or greater, and one or more hatches adjacent to the armored section, wherein the at least one seat in the turret basket is arranged directly beneath the armored section of the turret, and wherein the turret arrangement is configured to rotate about an axis that passes vertically through both the turret basket and the turret.

2. The combat vehicle of claim 1, wherein the armored section comprises a plurality of armor layers.

3. The combat vehicle of claim 2, wherein at least one of the plurality of armor layers includes ballistic steel.

4. The combat vehicle of claim 2, wherein at least one of the plurality of armor layers includes an airgap.

5. The combat vehicle of claim 1, wherein the turret further comprises an autoloader and the one or more hatches are arranged between the armored section and the autoloader.

6. The combat vehicle of claim 1, wherein the at least one seat is arranged on a track such that the at least one seat is configured to slide laterally between a first position directly beneath the armored section of the turret and a second position directly beneath one or more of the one or more hatches.

7. The combat vehicle of claim 1, wherein the turret basket comprises two seats that are arranged adjacent to one another and configured to face towards a front of the turret arrangement.

8. The combat vehicle of claim 1, wherein the at least one seat is not arranged directly beneath any of the one or more hatches.

9. A turret arrangement configured to couple to a hull of a combat vehicle, the turret arrangement comprising:

a turret basket that includes at least one seat; and a turret over the turret basket, the turret having an armored section with a thickness that is around 500 mm or greater, and one or more hatches adjacent to the armored section, wherein the at least one seat in the turret basket is arranged directly beneath the armored section of the turret.

10. The turret arrangement of claim 9, wherein the turret basket and the turret are configured to rotate together about an axis that passes vertically through both the turret basket and the turret.

11. The turret arrangement of claim 9, wherein the turret further comprises an autoloader and the one or more hatches are arranged between the armored section and the autoloader.

12. The turret arrangement of claim 9, wherein the at least one seat is arranged on a track such that the at least one seat is configured to slide laterally between a first position directly beneath the armored section of the turret and a second position directly beneath one or more of the one or more hatches.

13. The turret arrangement of claim 9, wherein the at least one seat in the turret basket does not extend above a bottom surface of the turret.

14. The turret arrangement of claim 9, wherein the at least one seat is not arranged directly beneath any of the one or more hatches.

15. A turret arrangement configured to couple to a hull of a combat vehicle, the turret arrangement comprising:

a turret basket that includes at least one seat; and a turret over the turret basket, the turret having a barrel, an autoloader, an armored section between the barrel and autoloader, and one or more hatches between the armored section and the autoloader, wherein a thickness of the armored section extends through an entire height of the turret, and wherein the at least one seat in the turret basket is arranged directly beneath the armored section of the turret.

16. The turret arrangement of claim 15, wherein the turret basket and the turret are configured to rotate together about an axis that passes vertically through both the turret basket and the turret.

17. The turret arrangement of claim 15, wherein the at least one seat is arranged on a track such that the at least one seat is configured to slide between a first position directly beneath the armored section of the turret and a second position directly beneath one or more of the one or more hatches.

18. The turret arrangement of claim 15, wherein the turret basket comprises 2 seats that are arranged adjacent to one another and configured to face towards a front of the turret arrangement.

19. The turret arrangement of claim 15, wherein the at least one seat in the turret basket does not extend above a bottom surface of the turret.

20. The turret arrangement of claim 15, wherein the at least one seat is not arranged directly beneath any of the one or more hatches.

* * * * *